US009461383B1

(12) United States Patent
Smith et al.

(10) Patent No.: US 9,461,383 B1
(45) Date of Patent: Oct. 4, 2016

(54) HIGH SIGNAL ISOLATION ELECTRICAL CONNECTOR

(71) Applicant: Amphenol Corporation, Wallingford, CT (US)

(72) Inventors: James Todd Smith, Portland, OR (US); Ken Capozzi, Navgatuck, CT (US); Michael A. Hoyack, Sandy Hook, CT (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 14/867,421

(22) Filed: Sep. 28, 2015

(51) Int. Cl.
*H01R 13/648* (2006.01)
*H01R 12/70* (2011.01)
*H01R 13/6597* (2011.01)

(52) U.S. Cl.
CPC ..... *H01R 12/7076* (2013.01); *H01R 13/6597* (2013.01)

(58) Field of Classification Search
CPC ..... H01R 12/7076; H01R 13/6597
USPC ..... 439/607.01, 79, 751
See application file for complete search history.

(56) References Cited

U.S. PATENT DOCUMENTS 3,879,103 A 4/1975 Peltola et al.
5,344,340 A 9/1994 Bouleau
5,580,276 A 12/1996 Mussen
6,676,445 B2 1/2004 Hall et al.
7,717,716 B2 5/2010 Dahms
8,105,092 B2 1/2012 Weidner et al.
8,333,596 B2 12/2012 Kang et al.
8,641,447 B2 * 2/2014 Sykes ..... H01R 24/44 439/582
2014/0127940 A1 5/2014 Wagner

FOREIGN PATENT DOCUMENTS

JP H-554919 A 3/1993

* cited by examiner

*Primary Examiner* — Javaid Nasri
(74) *Attorney, Agent, or Firm* — Blank Rome LLP

(57) ABSTRACT

An electrical connector for mounting to a printed circuit board that has a connector housing with a printed circuit board interface and a port supporting a central signal contact, and a metal component at the printed circuit board interface that has a hole corresponding the port. An outer contact is disposed in the port and surrounding the signal contact. The outer contact includes a conductive body that has a first end forming a ring and outwardly flared tines extending from the ring. Each tine has a flexible arm with a lip portion at a distal end thereof. The lip portion has an outer lead-in surface that tapers outwardly from the second end of the conductive body toward the first end. The lip portion has an outer shielding contact surface each adapted to contact the inner diameter surface of the hole of the metal component.

18 Claims, 2 Drawing Sheets

HIGH SIGNAL ISOLATION ELECTRICAL CONNECTOR

FIELD OF THE INVENTION

The present invention relates to electrical connector that provides high signal isolation. In particular, the invention provides an RF connector for connecting two printed circuit boards that is designed to prevent signal leakage.

BACKGROUND OF THE INVENTION

Signal leakage is a common problem for high density radio frequency (RF) connectors that are mounted to printed circuit boards (PCB). Therefore, isolation of any signal leakage from one signal port to another is an important requirement in electronic systems. The most difficult area to prevent leakage or cross talk is the junction between the PCB and the connector. That issue is amplified at the interface between the connector and the PCB when the connector is an all metal construction, which is typically done to improve signal isolation within the connector itself. There is often a small air gap left between the connector body and the PCB after installation. This gap is a significant leakage area. Most commonly, RF connectors are soldered to the PCB with an improved geometry to fence off one signal line from another to manage the leakage area. Typically this improved geometry included fully soldered surface mount barriers between adjacent lines. However, multi-port connector also tend to be larger with a larger thermal mass. Soldering of a connector with large mass can be difficult, problematic, or even impossible. The preferred method to attach large mass connectors is press fit type to allow effective connection without soldering. With press-fit RF connectors, the solutions for suppressing signal leakage are limited. One technique is to increase the number of ground contacts to create a fence to limit leakage at each port. However, that is not effective for very tight isolation specifications because a fence always allows some amount of leakage at the PCB launch. Another technique is to fit a compressible conductive EMI suppression gasket between the RF connector and the PCB. However, that technique introduces risk when additional factors, such as warpage of the connector or the PCB, as well as thermal cycles, which leads to compression set in the gasket, thereby significantly degrading signal isolation.

Another solution has been to add a metal component, such as a shim, between the RF connector and the PCB interface. The shim includes an array of holes that correspond to the high density ports of the RF connector. However, the holes still allow some signal leakage, which can be significant if one or more of the holes is offset due to a manufacturing issue and as such is misaligned with the ports of the connector. To address any leakage from the holes, one solution has been to use a cone shaped solid shield for each port for fitting into the respective holes of the shim. However, such a solid shield does not provide enough mechanical flexibility to address misalignment and varying tolerances in the shim holes, which would result in short term and long term reliability concerns. In the short term, if the cones are not sufficiently aligned with the holes, they will not result in a 360 degree contact joint and will therefore leak RF inconsistently. In the long term, there is a concern that the contact force between the cone and the hole will diminish. The contact in this case has minimal spring qualities to ensure the connection can be maintained over long periods with various environmental factors such as temperature vibration and shock. The contact joint being simply an interference fit between the cone and hole with soft materials to allow deformation. These materials can creep or permanently deform over time with temperature fluctuation and other mechanical stresses.

Therefore, a need exists for a high density RF connector that mounts to a PCB and maximizes signal isolation.

SUMMARY OF THE INVENTION

Accordingly, the present invention relates to an electrical connector for mounting to a printed circuit board. The electrical connector has a connector housing with a printed circuit board interface and at least one port that supports a central signal contact. A metal component is at the printed circuit board interface. The metal component has at least one hole corresponding the at least one port and the hole has an inner diameter surface. The improvement of the present invention provides at least one outer contact that is disposed in the at least one port at the printed circuit board interface of the connector housing. The outer contact surrounds the central signal contact. The outer contact has a conductive body that has opposite first and second ends. The first end forms a ring and is disposed in the connector housing at the at least one port. A plurality of outwardly flared tines extend from the ring. Each of the tines has a flexible arm with a lip portion at a distal end thereof. The lip portion has an outer lead-in surface that tapers outwardly from the second end of the conductive body toward the first end. The lip portion has an outer shielding contact surface. Each of the outer shielding contact surfaces is adapted to contact the inner diameter surface of the at least one hole of the metal component.

The present invention may further relate to an electrical connector for mounting to a printed circuit board. The electrical connector has a connector housing with a printed circuit board interface mounted to the printed circuit board and a plurality of ports. Each of the plurality of ports supports a central signal contact. A metal component is at the printed circuit board interface. The metal component has a plurality of holes. Each of the holes correspond to each of the ports and each of the holes has an inner diameter surface. The improvement of the present invention provides a plurality of outer contacts. Each of the plurality of outer contacts is disposed in one of the plurality of ports at the printed circuit board interface of the connector housing. Each of the outer contacts surrounds one of the central signal contacts. Each of the plurality of outer contacts includes a conductive body that has opposite first and second ends. The first end forms a ring disposed in the connector housing at a respective port. A plurality of outwardly flared tines extend from the ring. Each of the tines has a flexible arm with a lip portion at a distal end thereof. The lip portion has an outer lead-in surface that tapers outwardly from the second end of the conductive body toward the first end. The lip portion has an outer shielding contact surface. Each of the outer shielding contact surfaces is adapted to contact the inner diameter surface of one of the plurality of holes of the metal component.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION OF THE PREFERRED EMBODIMENTS

Figure 1:
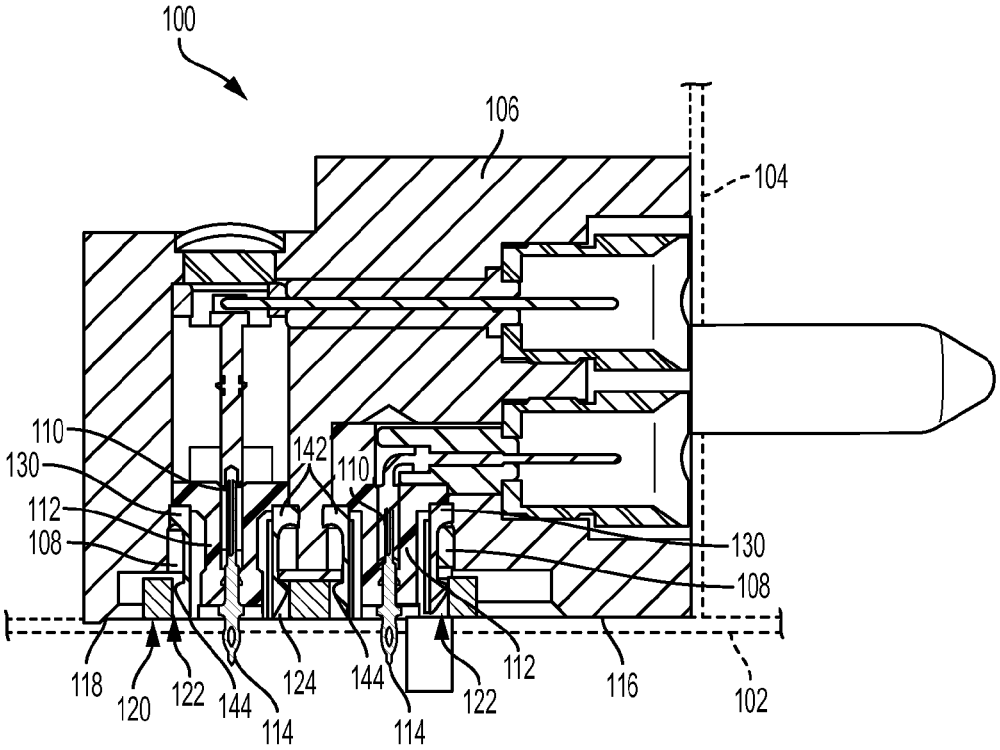
FIG. 1 is a perspective view of a high signal isolation electrical connector according to an exemplary embodiment of the present invention.

Referring to FIGS. 1-4, an exemplary embodiment of the present invention generally relates to an electrical connector 100, preferably an RF connector, that electrically connects two printed circuit boards 102 and 104, such as connecting a daughterboard to a motherboard. The electrical connector 100 of the present invention is configured to provide high isolation of the signals of the connector. The present invention incorporates mechanically flexible outer contacts 130 in the connector 100 that surround the individual signal contacts to prevent signal leakage and crosstalk.

The electrical connector 100 generally includes a housing 106 that supports a plurality of signal ports 108. Each signal port 108 has a central signal contact 110 supported by an insulation member 112. Each signal contact 110 preferably has a press fit tail end 114, such as an eye-of-the-needle (EON) end, that engages the printed circuit board 102. The opposite ends 116 of the signal contacts 110 are adapted to engage the second printed circuit board 104. Each signal contact 110 may be formed as one-piece or as more than one piece soldered together.

Figure 4:
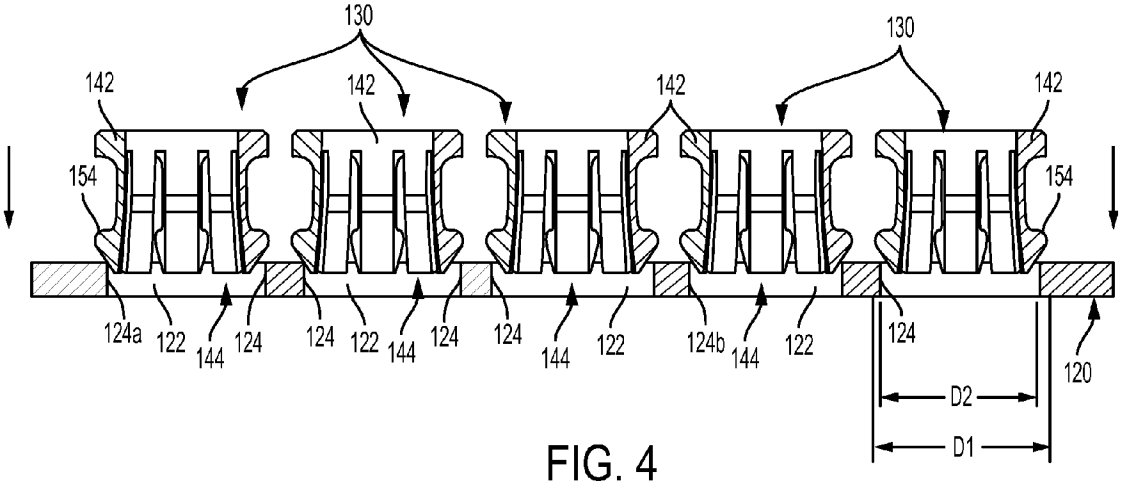
FIG. 4 is a cross-sectional view of multiple outer contacts of the electrical connector according the present invention.

The housing 106 includes at least one printed circuit board interface 116 that mounts to one of the printed circuit boards, such as PCB 102. A metal component 120, such as a shim, may be provided at the printed circuit board interface 116 of the housing 106, as best seen in FIG. 1. A recessed area 118 may be provided in the printed circuit board interface 116 of the housing 106 to accommodate the metal component 120. The metal component 120 includes a plurality of holes 122 that correspond to the signal ports 108 of the connector 100. Each hole 122 has an inner diameter surface 124. As seen in FIG. 4, the inner diameter of each hole 122 may varying due to manufacturing issues and tolerances. For example, the inner diameter 124*a* of one hole 122 may be slightly larger than the inner diameter 124*b* of another hole 122, as seen in FIG. 4. Also, some holes 122 may be offset such that some are spaced closer together than others.

The flexible nature of the outer contacts 130 of the present compensate for the manufacturing inconsistencies in and possible offset of the holes 122 of the metal component 120 that could results in misalignment, while also providing high signal isolation. Because of those inconsistencies of the inner diameters of the holes 122, a solid cone shaped shield would not work because some of the shields could be received in the holes while others could not. In other words, the solid cone shaped shields have no mechanical flexibility and therefore cannot account for any manufacturing offsets of the holes.

Each outer contact 130 is disposed in each port 108 and surrounds the respective signal contact 110 in that port to provide signal isolation of that contact 110. The insulation member 112 may also be provided in each port 108 that supports the signal contact 110 therein, such that the insulation member 112 is disposed between the signal contact 110 and the outer contact 130, as best seen in FIG. 1.

Each outer contact 130 generally includes a conductive body 140 with opposite first and second ends 142 and 144. Each outer contact 130 is positioned in the individual ports 108 such that the first end 142 of each outer contact 130 is secured in its respective port 108 and the second ends 144 of the outer contacts 130 are flush with the openings of the ports 108 at the interface 116 of the housing 106 with the printed circuit board.

Figure 2:
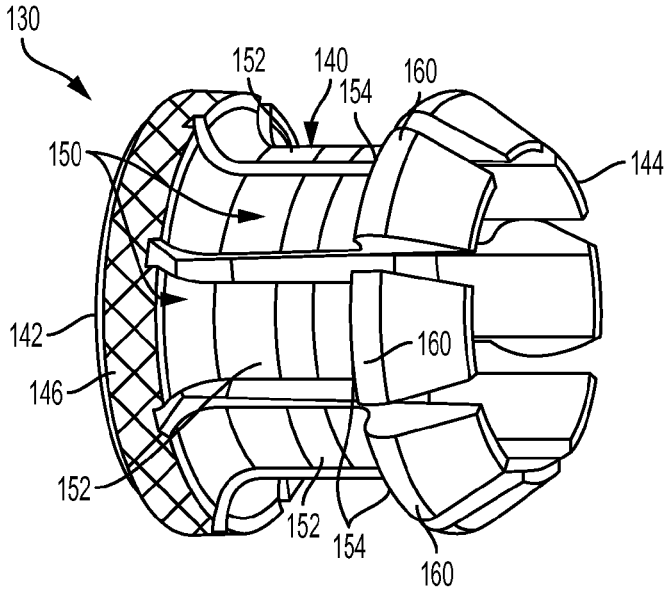
FIG. 2 is a perspective view of an outer contact of the electrical connector illustrated in FIG. 1.
Figure 3:
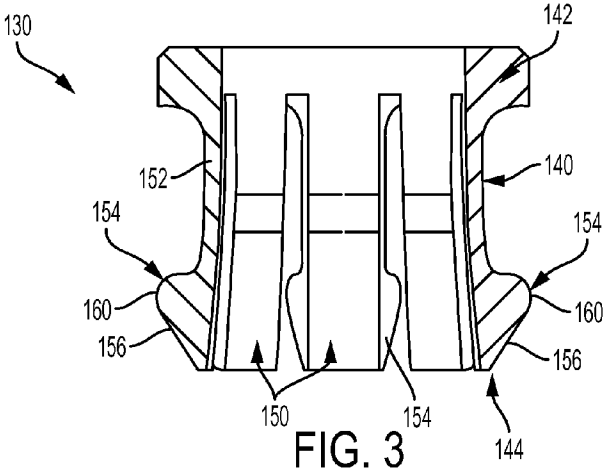
FIG. 3 is a cross-sectional view of the outer contact illustrated in FIG. 2.

The first end 142 of each outer contact 130 preferably forms a ring that may have a knurled outer surface 146 to facilitate attachment in the port 108. Extending from the first end 142 are a plurality of tines 150. The tines 150 are flexible and preferably flare outwardly, as seen in FIG. 3. Each tine 150 has a flexible arm 152 with a lip portion 154 at a distal end thereof for engaging the holes 122 of the metal component 120. The lip portions 154 form a discontinuous ring at the second end 144 of the outer contact, as seen in FIG. 2. An outer diameter D1 of that discontinuous ring is preferably larger than an inner diameter D2 of the inner diameter surface 124 of the hole 122 of the metal component 120, as seen in FIG. 4. Each lip portion 154 preferably has an outer lead-in surface 156 that assists with insertion of the outer contacts into the holes 122. The lead-in surface 156 tapers outwardly from the second end 144 of the conductive body 140 toward the first end 142.

Each lip portion 154 of the tines 150 has an outer shielding contact surface 160 that contacts the inner diameter surface 124 of a respective hole 122 to provide signal isolation. The outer shielding contact surfaces 160 may be rounded. The tines 150 are outwardly flared such that when the outer contacts 130 are inserted into the holes 122 of the metal component 120, the lip portions 154 are biased against the inner diameter surfaces 124 of the holes 122. In one preferred embodiment, each outer contact 130 includes eight tines 150 where the outer shielding contact surfaces 160 of at least six of those tines 150 contacts the inner diameter surface 124 in order to provide sufficient signal isolation. In other words, although it is preferred that all of the outer shielding contact surfaces 160 contact the hole's inner diameter surface 124, not all of the outer shielding contact surfaces 160 must contact the inner diameter surface 124 in order to provide high isolation of the signal through the signal contacts 110. It is sufficient for the outer shielding contact surfaces 160 of the tines 150 to contact at least 75 percent of the circumference of the inner diameter surface 124 of the hole 122 to provide high signal isolation.

While a particular embodiment has been chosen to illustrate the invention, it will be understood by those skilled in the art that various changes and modifications can be made therein without departing from the scope of the invention as defined in the appended claims. For example, although the connector 100 is shown as a right angle connector, the connector 100 of the present invention may also be a straight connector.

What is claimed is:

1. An electrical connector for mounting to a printed circuit board, the electrical connector having a connector housing with a printed circuit board interface, and at least one port supporting a central signal contact, and a metal component at said printed circuit board interface, said metal component having at least one hole corresponding said at least one port and said hole having an inner diameter surface, the improvement comprising of:

at least one outer contact being disposed in said at least one port at said printed circuit board interface of said connector housing, said outer contact surrounding said central signal contact, said outer contact including, a conductive body having opposite first and second ends, said first end forming a ring disposed in said connector housing at said at least one port, and a plurality of outwardly flared tines extending from said ring, each of said tines having a flexible arm with a lip portion at a distal end thereof, said lip portion having an outer lead-in surface that tapers outwardly from said second end of said conductive body toward said first end, and said lip portion having an outer shielding contact surface, each of said outer shielding contact surfaces being adapted to contact said inner diameter surface of said at least one hole of said metal component.

2. An electrical connector according to claim 1, wherein said outer shielding contact surfaces being biased against said inner surface of said at least one hole of said metal component.

3. An electrical connector according to claim 1, wherein said inner diameter surface defines a circumference; and said outer shielding contact surfaces contact at least 75 percent of said circumference of said inner diameter surface.

4. An electrical connector according to claim 1, wherein said outer contact includes at least eight tines, and said outer shielding contact surfaces of at least six of said eight tines contact said inner surface of said hole of said metal component.

5. An electrical connector according to claim 1, wherein said lip portions at said second end of said outer contact forms a discontinuous ring; and an outer diameter of said discontinuous ring is larger than an inner diameter of said inner diameter surface of said hole of said metal component.

6. An electrical connector according to claim 1, further comprising at least one insulative member disposed between said outer contact and said central signal contact.

7. An electrical connector according to claim 1, wherein said outer shielding contact surfaces are rounded.

8. An electrical connector according to claim 1, wherein said central signal contact has a press fit tail for engaging the printed circuit board.

9. An electrical connector according to claim 1, wherein said connector housing having a second printed circuit board interface for mounting to a second printed circuit board.

10. An electrical connector for mounting to a printed circuit board, the electrical connector having a connector housing with a printed circuit board interface mounted to the printed circuit board, and a plurality of ports, each of said plurality of ports supporting a central signal contact, and a metal component at said printed circuit board interface, said metal component having a plurality of holes, each of said holes corresponding to each of said ports and each of said holes having an inner diameter surface, the improvement comprising of:

a plurality of outer contacts, each of said plurality of outer contacts being disposed in one of said plurality of ports at said printed circuit board interface of said connector housing, each of said outer contacts surrounding one of said central signal contacts, each of said plurality of outer contacts including, a conductive body having opposite first and second ends, said first end forming a ring disposed in said connector housing at a respective port, and a plurality of outwardly flared tines extending from said ring, each of said tines having a flexible arm with a lip portion at a distal end thereof, said lip portion having an outer lead-in surface that tapers outwardly from said second end of said conductive body toward said first end, and said lip portion having an outer shielding contact surface, each of said outer shielding contact surfaces being adapted to contact said inner diameter surface of one of said plurality of holes of said metal component.

11. An electrical connector according to claim 10, wherein said outer shielding contact surfaces of each of said plurality of outer contacts is biased against said inner surface of said one of said plurality of holes of said metal component.

12. An electrical connector according to claim 11, wherein each inner diameter surface defines a circumference; and said outer shielding contact surfaces of each of said plurality of outer contacts contacts at least 75 percent of said circumference of each holes, respectively.

13. An electrical connector according to claim 12, wherein said lip portions at said second end of each of said plurality of outer contact forms a discontinuous ring; and an outer diameter of each of said discontinuous rings is larger than an inner diameter of said inner diameter surface of each of said plurality of holes of said metal component.

14. An electrical connector according to claim 13, further comprising an insulative member disposed between each of said plurality of outer contacts and each of said central signal contacts, respectively.

15. An electrical connector according to claim 14, wherein said central signal contact has a press fit tail for engaging the printed circuit board.

16. An electrical connector according to claim 15, wherein said connector housing having a second printed circuit board interface for mounting to a second printed circuit board.

17. An electrical connector according to claim 10, wherein each of said plurality of outer contact includes at least eight tines, and said outer shielding contact surfaces of at least six of said eight tines contact said inner diameter surface of each of said plurality of holes, respectively, of said metal component.

18. An electrical connector according to claim 10, wherein each of said outer shielding contact surfaces is rounded.

* * * * *